US008073363B2

(12) United States Patent
Mori

(10) Patent No.: US 8,073,363 B2
(45) Date of Patent: Dec. 6, 2011

(54) IMAGE FORMING APPARATUS WITH SHIFT REGULATING MEMBER

(75) Inventor: Hirotaka Mori, Ichinomiya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 739 days.

(21) Appl. No.: 11/505,941

(22) Filed: Aug. 18, 2006

(65) Prior Publication Data

US 2007/0048014 A1 Mar. 1, 2007

(30) Foreign Application Priority Data

Aug. 31, 2005 (JP) ..... 2005-251210

(51) Int. Cl.
*G03G 15/00* (2006.01)

(52) U.S. Cl. ..... 399/165; 399/302; 399/303

(58) Field of Classification Search ..... 399/162–165, 399/302, 303, 308
See application file for complete search history.

(56) References Cited

U.S. PATENT DOCUMENTS 6,035,158 A * 3/2000 Asakura et al. ..... 399/302
6,192,210 B1 2/2001 Munenori et al.
7,340,206 B2 * 3/2008 Takiguchi ..... 399/302
7,386,262 B2 * 6/2008 Okamura et al. ..... 399/298
2003/0016970 A1 * 1/2003 Omata et al. ..... 399/303

FOREIGN PATENT DOCUMENTS

| | | |
|---|---|---|
| JP | 11-45008 | 2/1999 |
| JP | 11-202644 | 7/1999 |
| JP | 2000-156478 | 6/2000 |
| JP | 2001-290401 | 10/2001 |
| JP | 2002-55536 | 2/2002 |
| JP | 2002-318505 | 10/2002 |
| JP | 2003-208039 | 7/2003 |
| JP | 2004-144997 | 5/2004 |

OTHER PUBLICATIONS

Notice of Reasons for Rejection received in corresponding Japanese Application No. 2005-251210, mailed on Feb. 8, 2011.
Office Action received in corresponding Japanese Applicition No. 2005-251210 mailed Aug. 24, 2010 (with machine trinslation attached—additional translation to follow).
Notice of Reasons for Rejection in corresponding Japanese Application No. 2005-251210, mailed Aug. 24, 2010.

* cited by examiner

*Primary Examiner* — David Gray
*Assistant Examiner* — Ruth N Labombard
(74) *Attorney, Agent, or Firm* — Banner & Witcoff, Ltd.

(57) ABSTRACT

A shift regulating member projecting from an inner circumferential side of a belt that engages an engaging member on a roller, and a pressing member that presses the belt are described. The pressing member may press the belt between the roller with the engaging member and another roller. In some aspects, the pressing member may be intermittently pressed against the belt.

23 Claims, 8 Drawing Sheets

IMAGE FORMING APPARATUS WITH SHIFT REGULATING MEMBER

CROSS REFERENCE TO RELATED APPLICATION

This application claims priority from Japanese Patent Application No. 2005-251210, filed on Aug. 31, 2005, the entire subject matter of which is incorporated herein by reference.

TECHNICAL FIELD

Aspects of the present invention relate to an image forming device. In particular, one or more aspects relate to a technology for preventing shifts of photoreceptor belts, intermediate transfer belts and paper conveyance belts that are used in image forming devices.

BACKGROUND

Conventionally, belts used in the image forming devices such as electronic photographic systems included conveyance belts for carrying recording media, photoreceptor belts for carrying developing agent images and intermediate transfer belts.

These belts are generally continuous belts that are suspended over a plurality of support rollers including drive rollers and are known to shift due to the occurrence of biasing forces in the lateral direction of the belts due to the shifts in the degree of alignment caused by tolerance in components and circumferential differences at both ends of the belt.

A shift regulating member projected inside at the end of the inner circumferential face of the belt is installed along the circumferential longitudinal direction, and an engagement member that engages with the shift regulating member is located at the position facing the shift regulating member at least on one of the support rollers over which the belt is suspended such that the shift regulating member and the engagement member are engaged to regulate shifting of belts.

A developing agent and paper powder tend to be easily adhered on the belt. In order to remove these particles, in other conventional systems, a cleaning member is brought into contact with the outer circumferential face of the belt to remove adhered substances such as developer and paper powder that have adhered to the belt.

However, for example, when using such a cleaning member, due to shifts of the degree of alignment between the cleaning member and the support roller, the application of force is generated to shift the belt so that even though a technology to prevent shifting of the belt is applied, there is a danger that the running of the belt becomes unstable.

This phenomenon occurs not only with cleaning members, but it also occurs when stress are applied to the running belts as in the case when a plurality of drums are in contact at the same time.

SUMMARY

At least some aspects of the present invention provide an image forming device that can stabilize the running ability of the belt. These and other aspects are described below.

DETAILED DESCRIPTION

It is noted that various connections are set forth between elements in the following description. It is noted that these connections in general and, unless specified otherwise, may be direct or indirect and that this specification is not intended to be limiting in this respect.

Illustrative aspects of the present invention are explained below with reference to the attached drawings. It is noted that various types of belts are used in conjunction with the shift regulating member or members. These belts may include belts such as conveyance belts for carrying recording media, photoreceptor belts for carrying developing agent images and intermediate transfer belts.

A. Example of Illustrative Embodiment 1:

Overall Constitution

Figure 1:
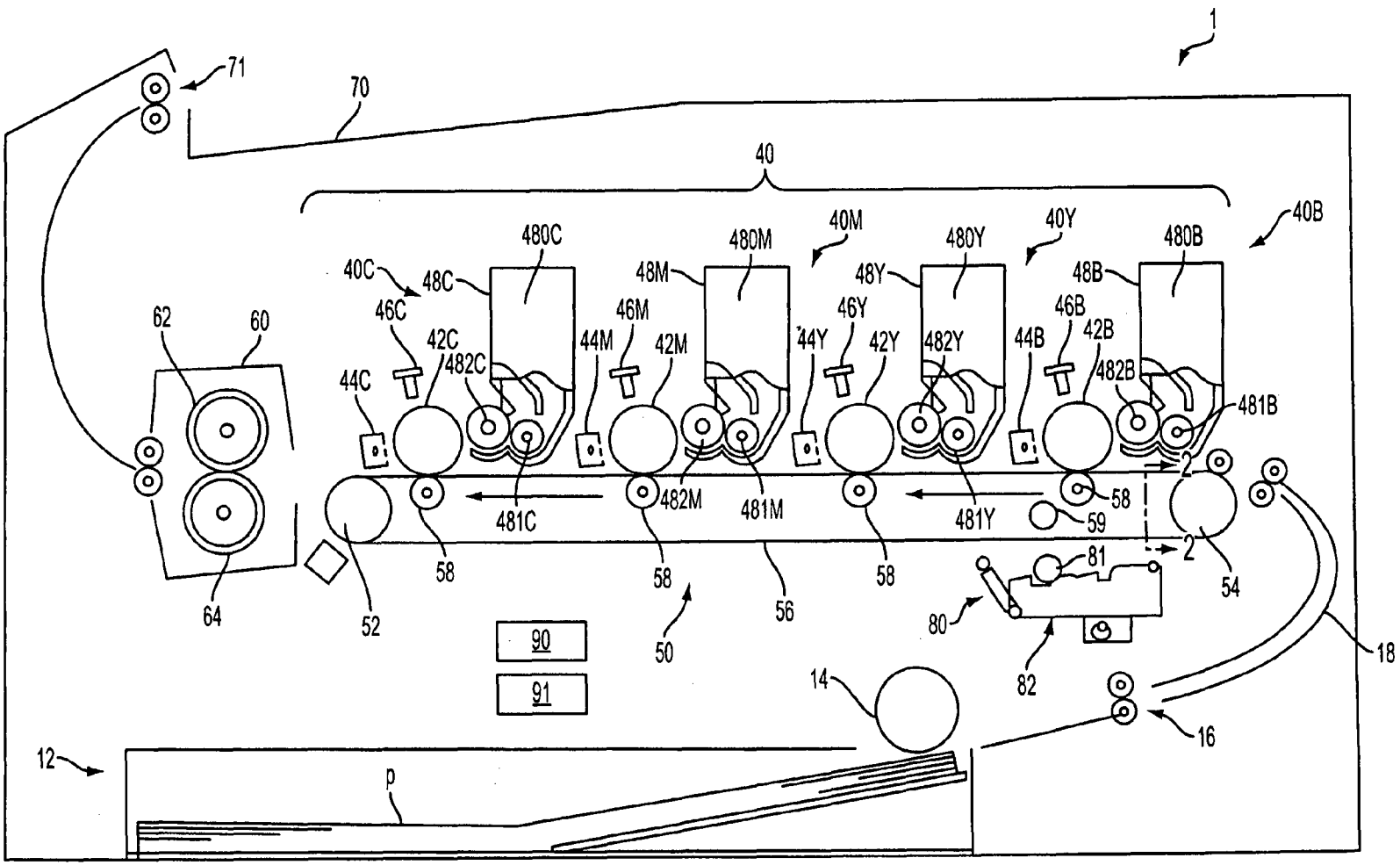
FIG. 1 is a central cross-sectional view of a printer according to at least one aspect of the invention.

FIG. 1 is a central cross-sectional view of a printer 1 in Example 1.

In FIG. 1, the up and down direction on the paper is an up and down direction in the example of illustrative embodiment, the left and right direction on the paper is the back and front direction in the example of illustrative embodiment, the direction towards the front of the paper is the right direction in the example of illustrative embodiment, and the direction towards the back of the paper is the left direction in the example of the illustrative embodiment.

Printer 1 may be a direct tandem-style color laser printer. As shown in FIG. 1, it is an image forming device equipped with a paper tray 12, a paper supply roller 14, a conveyance roller 16, a guide 18, a group of image forming units 40, conveyance units 50, a cleaning unit 80, a fixing unit 60, and a discharging roller 71.

Here, the paper tray 12 may be a boxed shape with an opening on the top that is detachable in the state wherein the paper P is set as a recording medium.

The paper feed roller 14 is positioned above the front end side of the paper tray 12 such that the paper P set in the paper tray 12 is extracted one sheet at the time.

The conveyance roller 16 is positioned at the downstream side in the direction of paper carriage (hereinafter called the downstream side) from the paper feed roller 14 such that the paper P extracted from the paper feed roller 14 is carried.

The guide 18 is located at the downstream side from the conveyance roller 16 such that the paper P carried out from the conveyance roller 16 is guided towards a group of image forming units 40.

A group of image forming units 40 is located at the downstream side from the guide 18 to form images on the paper P carried via the guide 18.

The conveyance unit 50 is located below the group of image forming units 40 and carries the paper P carried via the guide 18 along the position (copying position) where images are formed in the group of image forming units 40.

The cleaning unit 80 removes deposits such as developer adhered on the conveyance unit 50.

The fixing unit 60 is located at the downstream side from the group of image forming units 40 to fix the images formed on the paper P from the group of image forming units 40 on the paper P by applying heat and pressure.

The paper exit roller 71 is located at the downstream side from the fixing unit 60 to exit the paper P on which images are fixed by the fixing unit 60 into the exit tray 70.

The group of image forming units 40 is arranged along the carriage direction of the paper P by the conveyance unit 50 (the direction of an arrow in FIG. 1) and contains four image forming units 40C, 40M, 40Y, and 40B that respectively form images in cyan (C), magenta (M), yellow (Y), and black (B). The symbols having subscripts C, M, Y, and B after the numerical numbers indicate components constituting the respective image forming units 40C, 40M, 40Y, and 40B, the same numerical numbers indicate the components with the same constitution except for differences in the color of the developer to be formed.

Explanation of the image forming units 40M, 40Y, and 40B will be omitted since the image forming unit 40C is described as a representative unit.

The image forming unit 40C may include a photosensitive drum 42C as a photosensitive material carrying an electrostatic latent image, a charger 44C to perform charging to the photosensitive drum 42C, a scanner 46C for forming the electrostatic latent image in the photosensitive drum 42C, and a developing device 48C as a developing system wherein a developer image is formed by depositing a developer in the photosensitive drum 42C. In this case, a polymer toner is used as a developer.

The charger 44C is a Scorotron type charger that generates corona discharge from charged wire such as tungsten to uniformly positively charge the surface of the photosensitive drum 42C.

The scanner 46C contains a laser emitting device for generating a laser beam and lenses to form electrostatic latent images on the surface of the photosensitive drum 42C.

The developing device 48C may include a storage chamber 480C for storing a developer, a supply roller 481C for carrying the developer from the storage chamber 480C, and a developing roller 482C for forming developer images by supplying a developer carried from the supply roller 481C while charging the developer positively to the surface of the photosensitive drum 42C.

The conveyance unit 50, as shown in FIG. 1, includes a drive roller 52 located at the downstream side in the conveyance passage of the paper P that is rotating in the counter clockwise direction due to the driving force supplied from the motor as a drive source (not shown) in the printer 1, a follower roller 54 as a support roller located at the upstream side in the conveyance passage of the paper P, a continuous belt 56 moving in the counter clockwise direction (circumferential rotation) that is suspended between the drive roller 52 and the follower roller 54, and four transfer rollers 58 located respectively facing the photosensitive drums 42C, 42M, 42Y and 42B via the belt 56.

The cleaning unit 80 contains a cleaning roller 81 that removes deposits developers and/or paper powder adhered on the belt 56 when it is in contact with the belt 56. The cleaning roller 81 is arranged to face the circumferential face of the belt 56 such that the position of the cleaning roller 81 is aligned either to the position pressing to the inner circumferential side of the belt 56 or to the position distant from the belt 56.

The fixing unit 60 may include a heat roller 62 containing a halogen lamp along the axial direction of a metallic tube, and a press roller 64 for carrying the paper P from the conveyance unit 50 in a pressed state between the heat roller 62 towards the paper exit roller 71.

Next, the operation of the printer 1 will be explained.

After the surface of the photosensitive drum 42C is uniformly positively charged using the charger 44C, a modulated laser beam based on the image information of the images to be formed is irradiated from the scanner 46C onto the surface of the photosensitive drum 42C. Due to a drop in the voltage at the portion irradiated by the laser beam (exposure), an electrostatic latent image is formed on the surface of the photosensitive drum 42C.

Once a positively charged developer is supplied from the developing device 48C onto the surface of the photosensitive drum 42C, the developer is deposited only on the area exposed to the laser on the surface of the photosensitive drum 42C and a developer image is formed by visualization of the electrostatic latent image.

By rotating the photosensitive drum 42C, the developer image is moved to the position facing the transfer roller 58 (transfer position).

The same process is carried out for the image forming units 40M, 40Y, and 40B.

In parallel to the aforementioned operation, the paper P is carried by the rotation of the paper feed roller 14 and the transfer roller 16 towards the conveyance unit 50 and the group of image forming units 40.

The paper P is carried by the belt 56 driven by the drive roller 52 at a specific timing towards the transfer position.

Along with the conveyance of the paper P by the belt 56, transfer bias is applied to the respective gaps between the four photosensitive drums 42C, 42M, 42Y, and 42B and the corresponding transfer rollers 58 in order to transfer the developer image on the surface of the four photosensitive drums 40C, 40M, 40Y, and 40B sequentially onto the surface of the paper P to form a color image on the paper P.

The deposits adhered on the belt 56 are removed by the cleaning roller 81.

The color image formed on the surface of the paper P is fixed by carrying the paper P by rotating the pressure roller 64 in the fixing unit 60 while heating and applying pressure.

The paper P on which the developer image is fixed is exited from the paper exit roller 71 to the exit tray 70.

B. Conveyance Unit 50 and Cleaning Unit 80

Next, the conveyance unit 50 and the cleaning unit 80 will be described in detail with reference to the drawings FIG. 1 through FIG. 4.

(b-1) Conveyance Unit 50

Figure 2:
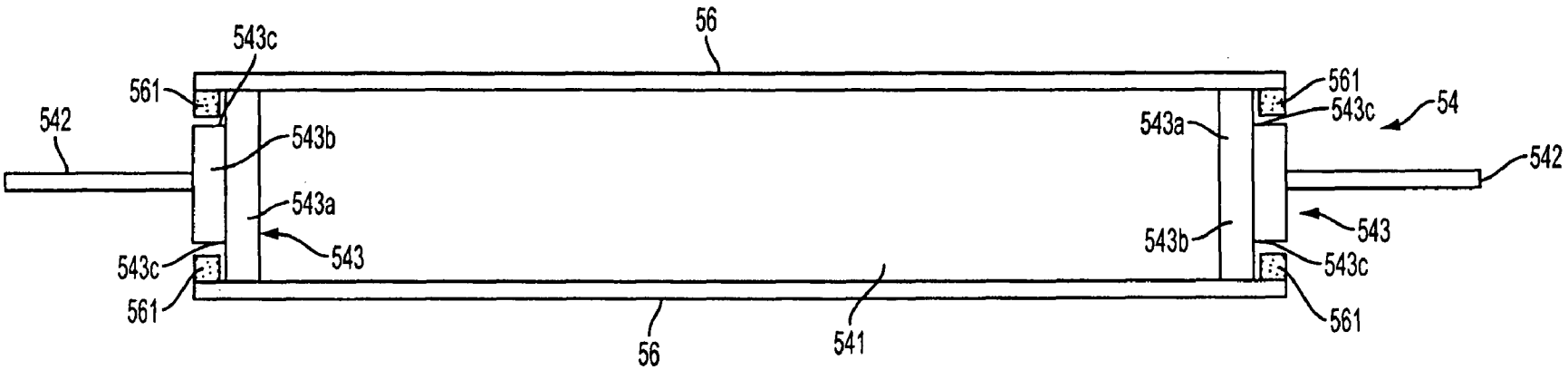
FIG. 2 is a cross-sectional view along the I-I line in FIG. 1.

FIG. 2 is a cross-sectional diagram along the line I-I in FIG. 1.

In the conveyance unit 50, as shown in FIG. 2, the belt 56 has a pair of shift regulating members 561 that are projected from the inner circumferential face at the both ends and that are installed along the moving direction of the belt 56. The follower roller 54 as a support roller consists of the roller body 541 supporting the inner circumferential face of the belt 56, a rotary shaft 542 fixed on the roller body 541 and a pair of engagement members 543 that are supported in freely rotatable manner to the rotary shaft 542, while they are arranged to face the shift regulating member 561 and to be engaged with the shift regulating member 561 to regulate shifts of belt 56.

The conveyance unit 50 is arranged to face the cleaning roller 81 via the belt 56, while it is equipped with a backup roller 59 that is supported in a freely rotatable manner on the frame of the body of the printer 1 (not shown).

The shift regulating member 561 is a rib having a square cross-section and is adhered on the entire circumference of the belt 56. The shift regulating member 561 is mainly made of urethane and silicone.

The engagement member 543, as shown in FIG. 2, has a large-sized flange 543*a* having almost the same diameter as that of the roller body 541 and a small-sized flange 543*b* having a smaller diameter than that of the large-sized flange 543*a* that is located at the end side of the rotary shaft 542 from the large-sized flange 543*a*. The shift of the belt 56 is regulated when the gap portion 543*c* formed between the side facing the edge side of the rotary shaft 542 of the large-sized flange 543*a* and the circumferential surface of the small-sized flange 543*b* is engaged with the shift regulating member 561. For example, the large-sized flange 543*a*, the small-sized flange 543*b*, and the roller body 541 are applicable a unitary style or an anomalous style each other.

Figure 3A:
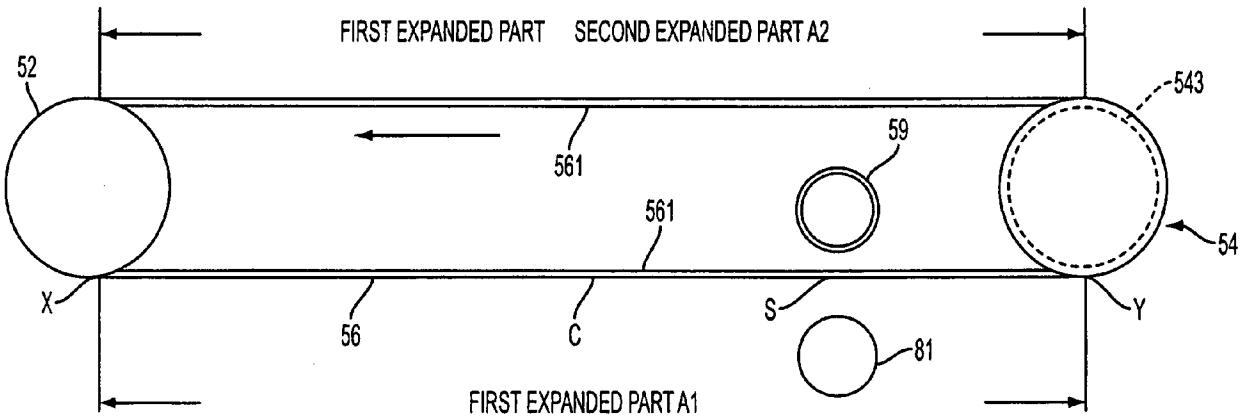
FIG. 3A is a cross-sectional view of the conveyance unit when the cleaning roller is distant from the belt according to at least one aspect of the invention.
Figure 3B:
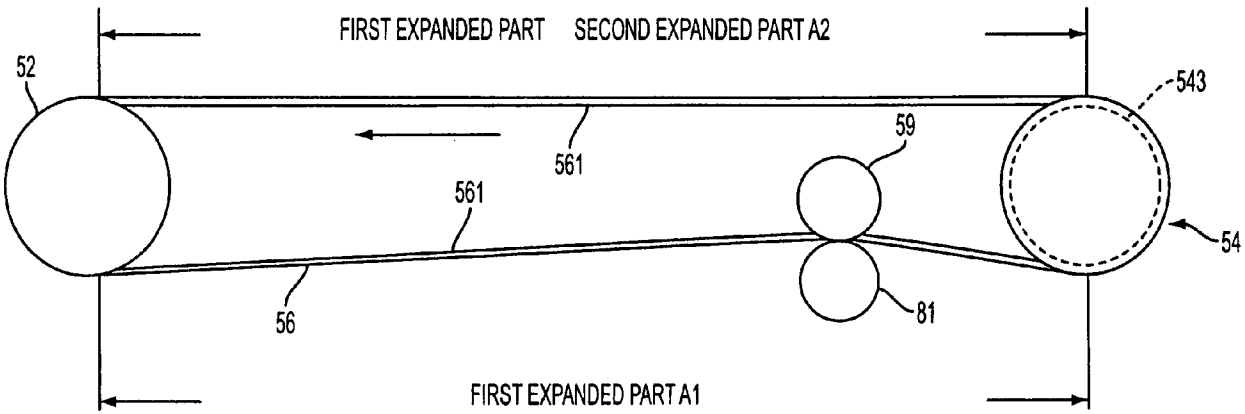
FIG. 3B is a cross-sectional view of the conveyance unit when the cleaning roller presses the belt to the inner circumferential side according to at least one aspect of the invention.

FIG. 3A is a cross-sectional view of the conveyance unit 50 when the cleaning roller 81 is distant from the belt 56. FIG. 3B is a cross-sectional view of the conveyance unit 50 when the cleaning roller 81 presses the belt 56 to the inner circumferential side.

As shown in FIG. 3A and FIG. 3B, when the belt 56 is suspended between the follower roller 54 and the drive roller 52 adjacent to the roller along the belt moving direction, a first expanded part A1, A2 is formed. The first expanded part located at the upstream side in the belt moving direction of the follower roller 54 is called a first expanded part A1 and the first expanded part located at the downstream side in the belt moving direction of the follower roller 54 is called a first expanded part A2. Moreover, the first expanded part A2 is suspended between the drive roller 52 and the follower roller 54 adjacent to the drive roller 52 in the upstream side in the belt moving direction of the drive roller 52, constituting a second expanded part A2 as the second expanded part in the present invention. In other words, the first expanded part A1 refers to the unsupported belt located adjacent to the roller with engagement member. The second expanded part A2 refers to the belt that contacts a print medium or conveys an image to the print medium. As shown in FIG. 1, the second part may or may not be supported by additional rollers 58.

(b-2) Cleaning Unit 80

Figure 4A:
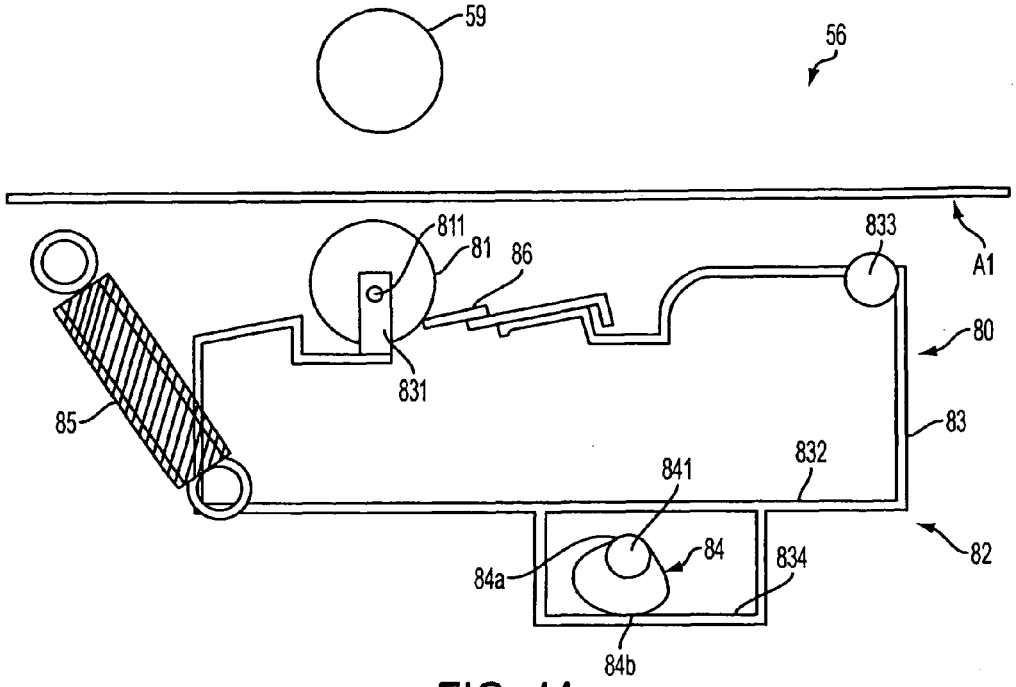
FIG. 4A is a cross-sectional view of the cleaning unit when the cleaning roller is distant from the circumference face of the belt according to at least one aspect of the invention.
Figure 4B:
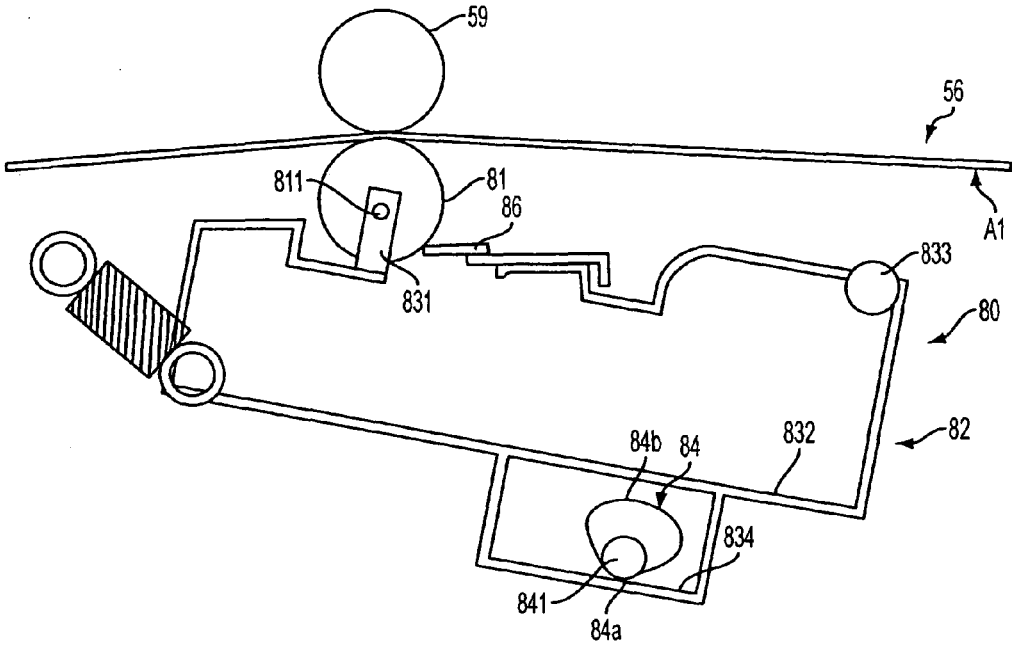
FIG. 4B is a cross-sectional view of the cleaning unit when the cleaning roller presses the circumference face of the belt to the inner circumference side according to at least one aspect of the invention.

FIG. 4A is a cross-sectional view of the cleaning unit 80 when the cleaning roller 81 is distant from the circumferential surface of the belt 56. FIG. 4B is a cross-sectional view of the cleaning unit 80 when the cleaning roller 81 is pressed on the circumferential surface of the belt 56 into the inner circumferential side.

As shown in FIG. 1, FIG. 4A and FIG. 4B, that is, as shown in FIG. 3A and FIG. 3B, the portion located at the Y side from the center point C of the line connecting between the point X where the belt 56 starts going away from the drive roller 52 towards the downstream side in the belt moving direction and the point Y where the belt 56 starts contacting the follower roller 54 from the upstream side in the belt moving direction on the cross-section where the belt 56 crosses at a right angle in the lateral direction, presses towards the inner circumferential side.

The rotary shaft 833 is supported in a rotatable manner in the frame of the body of the printer 1 that is not shown, and the rear end of the cabinet 83 can be moved in an up and down direction.

Spring 85 is in a coiled shape, one end is fixed at the rear end of the cabinet 83, and the other end is fixed in the frame of the body of the printer 1 that is not shown, and it pushes the rear end of the cabinet 83 upwards.

The cam 84 has almost a fan shaped cross-section, and a shaft 841 is fixed at one end creating a close proximity area 84*a* to the shaft 841 and a distant area 84*b* from the shaft 841 than the close proximity are 84*a* on the circumferential surface that is in contact with the contact surface 834 in the cabinet 83. The shaft 841 is connected to a drive source 91 in order to switch the rotary position of the cam 84 between the position when the close proximity area 84*a* becomes in contact with the contact face 834 and the position when the distant area 84*b* becomes in contact with the contact face 834. The cabinet 83 is positioned at an upper position such that the rear end of the cabinet 83 is located upwards when the close proximity area 84*a* of the cam 84 is in contact with the contact face 834, whereas it is positioned at a lower position against the pressing force of the spring 85 when the distant area 84*b* of cam 84 is in contact with the contact face 834. The cleaning roller 81 is positioned to press the first expanded part A1 if the cabinet 83 is positioned at an upper position, whereas it is positioned to be away from the first expanded part A1 if the cabinet 83 is positioned at a lower position.

As shown in FIG. 3A and FIG. 3B, when the first expanded part A1 is pressed by the cleaning roller 81, the area S when the dislocation from the position when the first expanded part A1 is not pressed is the greatest is disposed above for a few millimeters (inner circumferential side) when compared to the time when the cleaning roller 81 is distant from the first expanded part A1. FIG. 3B illustrates an exaggeration of this dislocation.

The blade 86 is fixed in the cabinet 83 such that when the tip of the cleaning roller 81 below becomes in contact with the circumferential face of the cleaning roller 81, the deposits captured on the circumferential surface of the cleaning roller 81 are scraped off.

The control unit 90 receives signals when the tip of the paper P contacts the photosensitive drum 42B as detected by a sensor that is not shown, and also receives signals when the rear end of the paper P contacts the photosensitive drum 42C. During the period from the time when the tip of the paper P touches the photosensitive drum 42B to the time when the rear end of the paper P touches the photosensitive drum 42C (when forming an image), the control unit 90 controls the drive source 91 to switch such that the cam 84 is positioned such that the distant area 84*b* becomes in contact with the contact face 834. After the rear end of the paper P passes the photosensitive drum 42C, the cam 84 is positioned such that the close proximity area 84*a* becomes in contact with the contact face 834.

(b-3) Operations of Cleaning Unit 80 and Conveyance Unit 50

Next, operations of the cleaning unit 80 and the conveyance unit 50 are explained below.

The cleaning roller 81 is arranged at a position distant from the first expanded part A1 when the cabinet 83 is positioned at a lower position by the control unit 90 via the cam 84 while the developer images on the four photosensitive drums 40C, 40M, 40Y, and 40B are sequentially transferred on the surface of the paper P (at the time of image formation). In this case, the first expanded part A1 is expanded linearly.

When the image formation is completed, the position of the cleaning controller 81 is switched such that it presses the first expanded part A1 to the inner circumferential side by positioning the cabinet 83 at an upper position via the cam 84 by the action of the control unit 90. In this case, the first expanded part A1 is curved into the inner circumferential side so that the engaged area between the shift regulating member 561 and the engagement member 543 increases. At this point, a backup roller 59 holds the belt 56 in the space with the cleaning roller 81. The engaged area implies an area when the engagement member 543 exhibits the shift regulating ability. The engagement member 543 exhibits the shift regulating ability in the region facing the portion of the belt 56 to which a force is acting in the direction in contact with the follower roller 54.

When the image formation is started again, the position of the cleaning roller 81 is switched to such a position that it [the cleaning roller 81] goes away from the first expanded part A1.

(b-4) Effects of the Constitution of Example of Illustrative Embodiment 1

Next, the effects of the constitution of Example of Illustrative Embodiment 1 are explained below.

While the cleaning roller 81 presses the first expanded part A1, shifting force is given to the belt due to the shifts in the degrees of parallelism of the cleaning roller 81 relative to the drive roller 52 and the follower roller 54. However as the area where the belt 56 contacts the follower roller 54 increases as the first expanded part A1 is pressed, the engagement area between the engaged member 543 and the shift regulating member 561 that belongs to the follower roller 54 increases so that the running quality of the belt 56 becomes more stable than that in the prior art.

Since the cleaning roller 81 presses the first expanded part A1 that is different from the second expanded part A2 used as an image forming region where the four photosensitive drums 42C, 42M, 42Y, and 42B are positioned to be facing, the effects of the cleaning roller 81 on the image formation can be suppressed.

The shift regulating member 561 may invade the area supporting the inner circumference of the belt when engaged with the engagement member 543 from the upstream side in the belt moving direction, that is, the circumferential area of the roller body 541 or large-sized portion 543*a*, but such a possibility can be reduced if the cleaning roller 81 presses the first expanded part A1 at the upstream side of the follower roller 54.

Since the cleaning roller 81 is positioned to face the portion located at the side of follower roller 54 rather than the center portion in the belt moving direction of the first expanded part A1, the engaged region between the shift regulating member 561 and the engagement member 543 located along the circumferential longitudinal direction of the belt 56 further increases so that the running quality of the belt 56 becomes even more stable.

The cleaning roller 81 is distant from the belt 56 during the time of non-image formation so that less pressure is applied to the belt 56 when compared to the case when the cleaning roller 81 always presses the belt 56, making possibility of long-term use possible.

When compared to the general use of the cleaning blade, the ability of removing deposits of the belt 56 is much higher when using the cleaning roller 81 so that deposits can be removed with higher assurance.

In the printer 1, a polymer toner is used as a developer. The polymer toner deposited on the belt 56 can form higher quality images. In contrast, when compared to the deposits of crushed toner on the belt 56, its flowability is high and it is much more difficult to be removed so that it is necessary to press the cleaning roller 81 much stronger to the belt 56. For this reason, the force of shifting the belt 56 becomes greater than that applied when removing crushed toner. As a result, the shift regulating member 561 becomes easily disengaged from the engagement membrane 543. Therefore, it is effective to apply the constitution of the present example of illustrative embodiment to the printer 1 using a polymer toner.

Example of Illustrative Embodiment 2

Next, Example of Illustrative Embodiment 2 of the present invention is explained below with reference to FIG. 5A and FIG. 5B.

In Example of Illustrative Embodiment 2, a partial constitution of the conveyance unit 50 and the arrangement of the cleaning roller 81 are different from those in Example of Illustrative Embodiment 1, but other portions are same as those in Example of Illustrative Embodiment 1. Therefore, the portions with the same constitution are indicated by the same symbols and the detailed explanations are omitted.

Figure 5A:
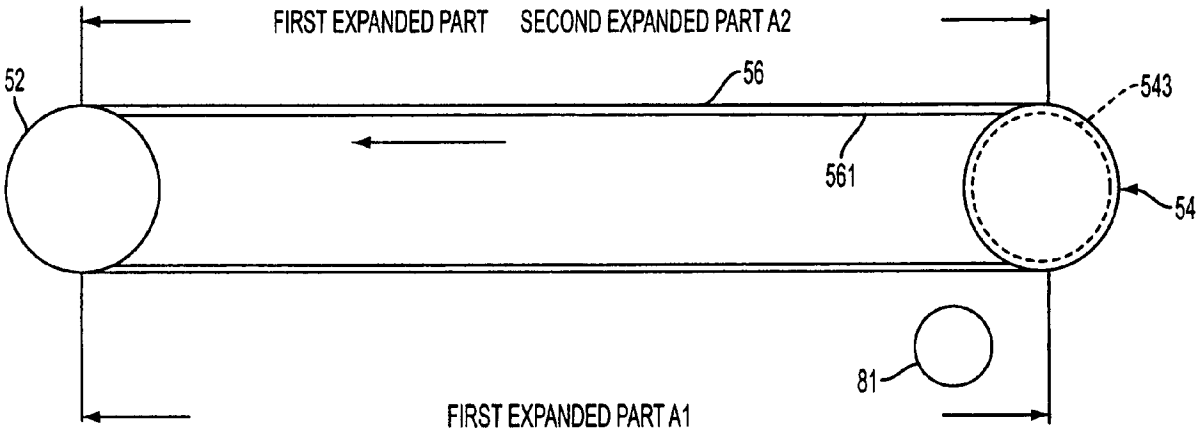
FIG. 5A is a cross-sectional view of the conveyance unit when the cleaning roller is distant from the belt according to at least one aspect of the invention.
Figure 5B:
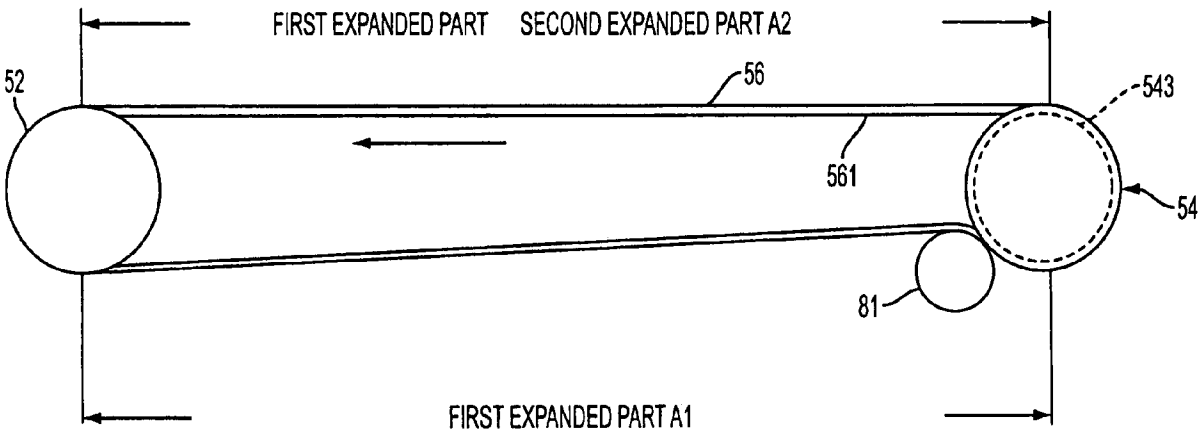
FIG. 5B is a cross-sectional view of the conveyance unit when the cleaning roller presses the belt to the inner circumference side according to at least one aspect of the invention.

FIG. 5A is a cross-sectional view of the conveyance unit 50 when the cleaning roller 81 is distant from the belt 56. FIG. 5B is also a cross-sectional view of the conveyance unit 50 when the cleaning roller 81 presses the belt 56 into the inner circumference side.

The cleaning roller 81 is located at such a position that it overlaps the projection of the follower roller 54 in the perpendicular direction.

The backup roller 59 in Example of Illustrative Embodiment 1 is not installed in Example of Illustrative Embodiment 2.

The position of the cleaning roller 81 is switched by the position adjustment mechanism 82 as shown in FIG. 4A and FIG. 4B between the position distant from the first expanded part A1 and the position pressing the first expanded part A1. When the cleaning roller 81 is at the position to press the first expanded part A1, the cleaning roller 81 folds the belt 56 in the space between the follower roller 54 and another roller (for example, roller 52).

According to the constitution in Example of Illustrative Embodiment 2, the backup roller 59 that holds the belt 56 with the cleaning roller 81 can be eliminated so that the constitution of the printer 1 becomes easier. Also, the cleaning roller 81 directly winds the first expanded part A1 around the follower roller 54, the engaged region between the engagement member 543 and the shift regulating member 561 increases when compared to Example of Illustrative Embodiment 1 even though the degree of pressure applied is the same so that the running quality of the belt 56 become more stable.

Example of Illustrative Embodiment 3

Next, Example of Illustrative Embodiment 3 of the present invention is explained below with reference to FIG. 6A and FIG. 6B.

In Example of Illustrative Embodiment 3, a partial constitution of the conveyance unit 50 and the arrangement of the cleaning roller 81 are different from those in Example of Illustrative Embodiment 1, but other portions are same as those in Example of Illustrative Embodiment 1. Therefore, the portions with the same constitution are indicated by the same symbols and the detailed explanations are omitted.

Figure 6A:
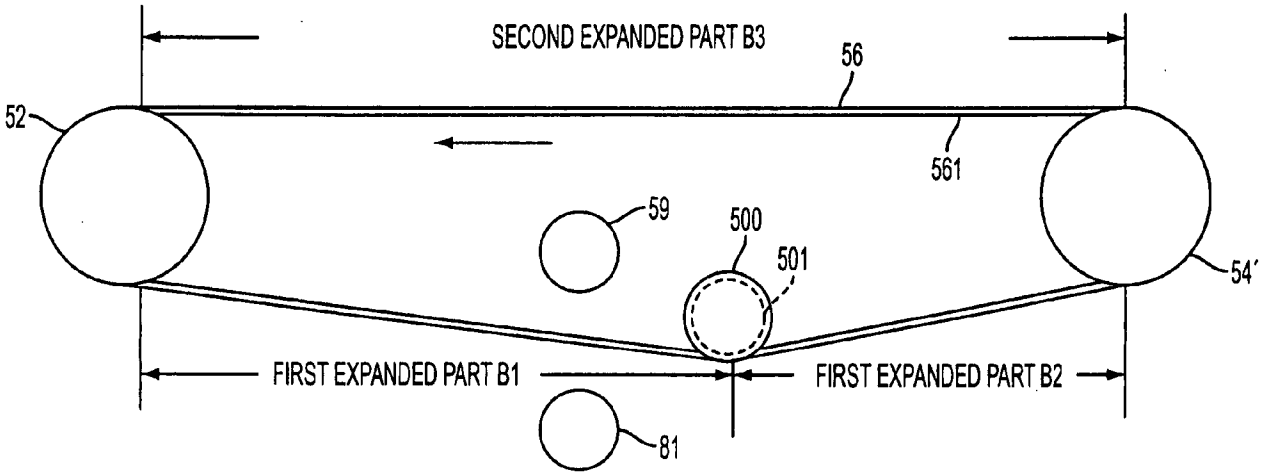
FIG. 6A is a cross-sectional view of the conveyance unit when the cleaning roller is distant from the belt.

FIG. 6A is also a cross-sectional view of the conveyance unit 50 when the cleaning roller 81 presses the belt 56 into the inner circumference side.

Figure 6B:
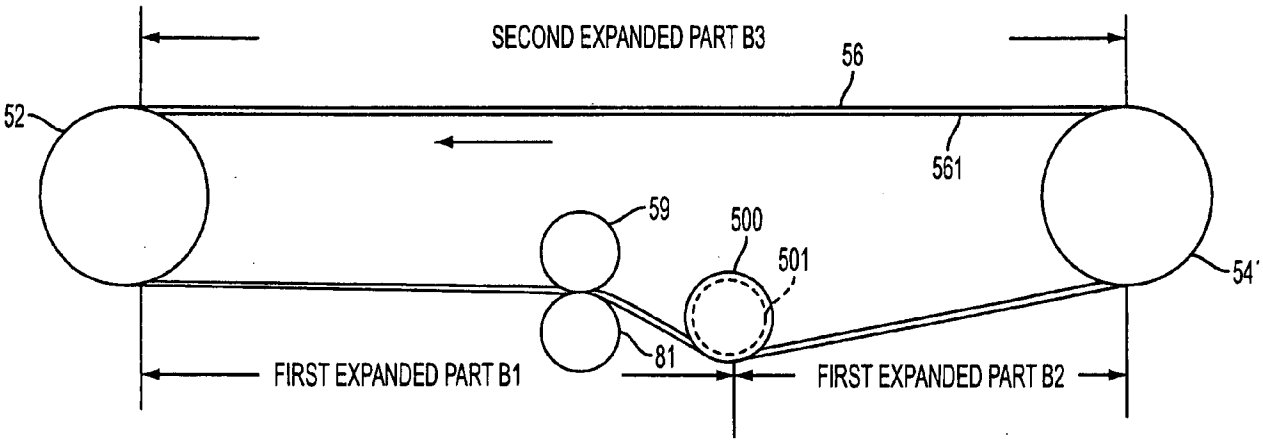
FIG. 6B is a cross-sectional view of the conveyance unit when the cleaning roller presses the belt to the inner circumference side according to at least one aspect of the invention.

In Example of Illustrative Embodiment 3, as shown in FIG. 6A and FIG. 6B, the belt 56 is suspended in the following order in a clockwise direction in the figure: follower roller 54', support roller 500 having the shift regulating member 561 engaged with the engagement member 501, and the drive roller 52.

The engagement member 501 is the same as the engagement member 534 of the follower roller 54 in Example of Illustrative Embodiment 1 and is supported by the rotary shaft of the support roller 500 in a rotatable manner.

As shown in FIG. 6A and FIG. 6B, the belt 56 is suspended between the support roller 500 having the engagement member 501 and the drive roller 52 adjacent to the support roller 500 at the upstream side along the belt moving direction to form a first expanded part B1, and also suspended between the support roller 500 and the follower roller 54' adjacent to the support roller 500 at the downstream side along the belt moving direction to form a first expanded part B2. Also it is suspended between the drive roller 52 and the follower roller 54' adjacent to the drive roller 52 at the upstream side along the belt moving direction to form a second expanded part B3.

In Example of Illustrative Embodiment 3, the cleaning roller 81 is arranged to face the first expanded part B1.

Example of Illustrative Embodiment 4

Next, Example of Illustrative Embodiment 4 is explained below with reference to FIG. 7A and FIG. 7B.

In Example of Illustrative Embodiment 4, the constitution to press the belt 56 to the inner circumference side is different from Example of that in Illustrative Embodiment 1, but other portions are same as those in Example of Illustrative Embodiment 1.

Therefore, the portions with the same constitution are indicated by the same symbols and the detailed explanations are omitted.

Figure 7A:
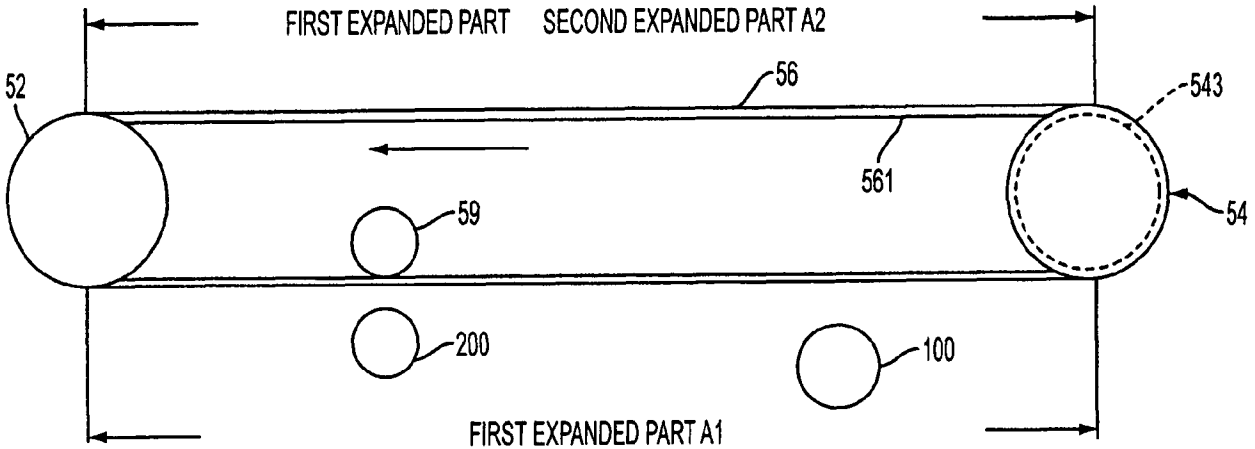
FIG. 7A is a cross-sectional view of the conveyance unit when the pressing member is distant from the belt according to at least one aspect of the invention.
Figure 7B:
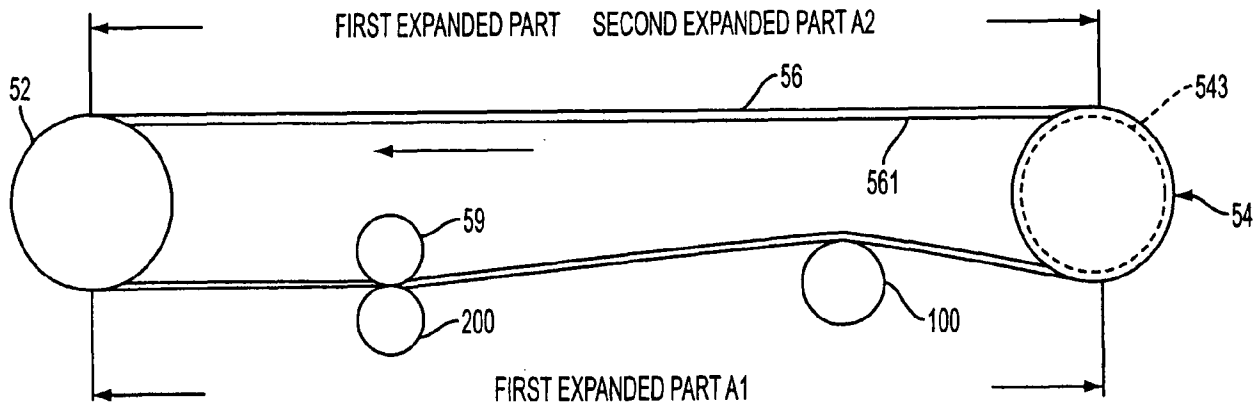
FIG. 7B is a cross-sectional view of the conveyance unit when the pressing member presses the belt to the inner circumference side according to at least one aspect of the invention.

FIG. 7A is a cross-sectional view of the conveyance unit 50 when the pressing member 100 is distant from the belt 56. FIG. 7B is also a cross-sectional view of the conveyance unit 50 when the pressing member 100 presses the belt 56 into the inner circumference side.

The cleaning roller 200 as a disjunctive member is arranged to face the first expanded part A1 and the position of the cleaning roller 200 can be exchangeable between the position in contact with the first expanded part A1 and the position distant from the first expanded part A1. More precisely, the cleaning roller 200 is arranged at such a position that the portion located at the side of follower roller 54 is pressed rather than at the center in the belt moving direction of the first expanded part A1.

The mechanism of disjunction of the cleaning roller 200 from the first expanded part A1 is the same as the position switching mechanism 82 as in Example of Illustrative Embodiment 1. In this case, the cleaning roller 200 in Example of Illustrative Embodiment 4 only becomes in contact with the first expanded part A1 and it is not pressed to the inner circumference side.

The pressing member 100 is positioned at the downstream in the belt moving direction to the cleaning roller 200 in the first expanded part A1. The pressing member 100 as in cleaning roller 200 in Example of Illustrative Embodiment 1 is supported by the same position switching mechanism 82 in a rotatable manner as in Example of Illustrative Embodiment 1, and the position of the pressing member 100 is switched by the position switching mechanism 82 between the position where the first expanded part A1 is pressed to the inner circumference side and the position distant from the first expanded part A1.

The pressing member 100 is a follower roller rotating along the movement of the first expanded part A1 when it is pressed to the first expanded part A1. When the cleaning roller 200 is in contact with the first expanded part A1, it presses the belt 56 to the inner circumference side, whereas when the cleaning roller 200 is distant from the first expanded part A1, it moves away from the belt 56.

Next, the effects of the present example of illustrative embodiment are described.

While the cleaning roller 200 is in contact with the first expanded part A1, a shifting force is given to the belt due to the shifts in the degrees of parallelism of the cleaning roller 200 relative to the drive roller 52 and the follower roller 54. However, as the first expanded part A1 is pressed by the pressing member 100, the engaged area between the engagement member 543 and the shift regulating member 561 that belongs to the follower roller 54 increases so that the running quality of the belt 56 becomes more stable.

Since the pressing member 100 presses the first expanded part A1 that is different from the second expanded part A2 used as an image forming region where the four photosensitive drums 42C, 42M, 42Y, and 42B are positioned to be facing, the effects of the pressing member 100 on the image formation can be suppressed.

The shift regulating member 561 may invade the roller body 541 or large-sized portion 543*a* when engaged with the engagement member 543 from the upstream side in the belt moving direction, but such a possibility can be reduced if the pressing member 100 presses the first expanded part A1 at the upstream side of the follower roller 54.

Since the pressing member 100 is positioned to face the portion located at the side of follower roller 54 rather than the center portion in the belt moving direction of the first expanded part A1, the engaged region between the shift regulating member 561 and the engagement member 543 located along the circumferential longitudinal direction of the belt 56 further increases so that the running quality of the belt 56 becomes much more stable.

The pressing member 100 is distant from the belt 56 during the time of non-image formation so that less stress is applied to the belt 56 when compared to the case when the cleaning roller 200 always presses the belt 56 and long-term use becomes possible.

The pressing member 100 is equipped such that it presses the belt 56 to the inner circumference side when the cleaning roller 200 is in contact with the first expanded part A1, whereas it becomes distant from the belt 56 when the cleaning roller 200 is distant from the first expanded part A1. Therefore, less stress is applied to the belt when compared to the case when pressing member 100 presses the first expanded part A1.

Since the pressing member 100 is a roller, less stress tends to be applied than the case when using a blade.

A cleaning roller may be installed disjunctively to the belt, and a shifting force may be generated when the cleaning roller is in contact with the belt, thus it is effective to apply a cleaning roller as a disjunctive member of the present invention.

Example of Illustrative Embodiment 5

Next, Example of Illustrative Embodiment 5 is described below with reference to FIG. 8A and FIG. 8B.

The constitution of Example of Illustrative Embodiment 5 is the same as that of Example of Illustrative Embodiment 4 except for that the constitution of the conveyance unit 50 and the arrangements for the pressing member 100 and the cleaning roller 200 are different from those in Example of Illustrative Embodiment 4. Therefore, the portions with the same constitution are indicated by the same symbols as in Example of Illustrative Embodiment 4 and the detailed explanations are omitted.

Figure 8A:
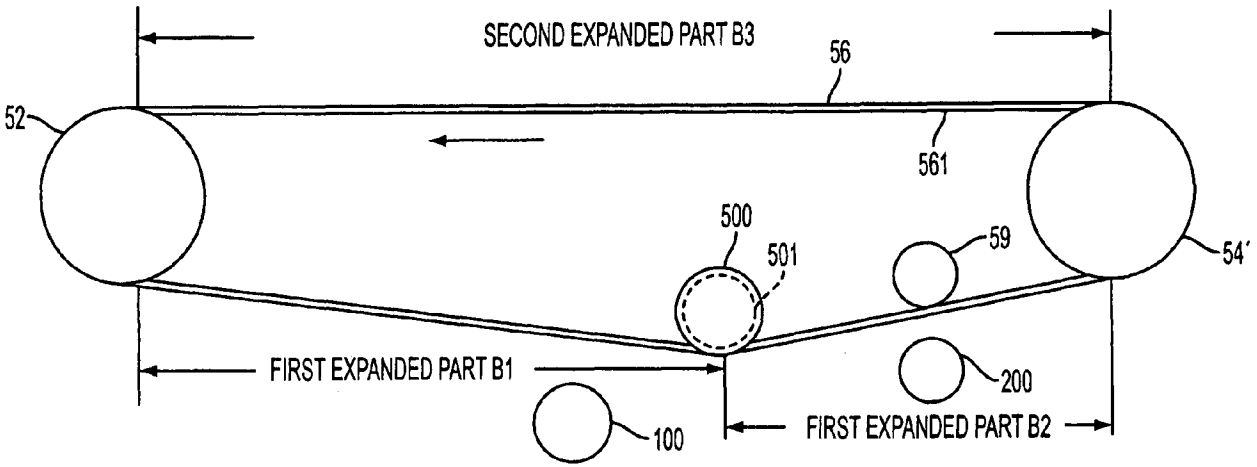
FIG. 8A is a cross-sectional view of the conveyance unit when the pressing member is distant from the belt according to at least one aspect of the invention.

FIG. 8A is a diagram when the pressing member 100 is distant from the belt 56.

Figure 8B:
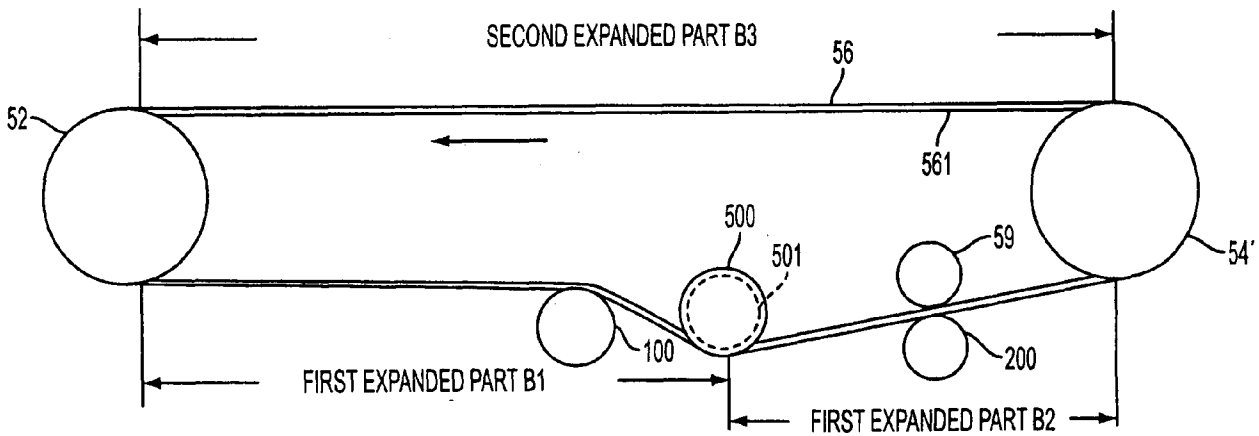
FIG. 8B is a cross-sectional view of the conveyance unit when the pressing member presses the belt to the inner circumference side according to at least one aspect of the invention.

FIG. 8B is a diagram when the pressing member 100 presses the belt 56.

In Example of Illustrative Embodiment 5, as shown in FIG. 8A and FIG. 8B as in Example of Illustrative Embodiment 3, the belt 56 is suspended in the following order in the clockwise direction in the figure: follower roller 54', support roller 500 having the shift regulating member 561 engaged with the engagement member 501, and the drive roller 52.

The engagement member 501 is the same as the engagement member 43 of the follower roller 54 in Example of Illustrative Embodiment 1.

As shown in FIG. 8A and FIG. 8B, the belt 56 is suspended between the support roller 500 having the engagement member 543 and the drive roller 52 adjacent to the support roller 500 at the upstream side along the belt moving direction to form a first expanded part B1, and also suspended between the support roller 500 having and the follower roller 54' adjacent to the support roller 500 at the downstream side along the belt moving direction to form a first expanded part B2. Also it is suspended between the drive roller 52 and the adjacent follower roller 54' at the upstream side along the belt moving direction to form a second expanded part B3.

The pressing member 100 is arranged to face the first expanded part B1 and the cleaning roller 200 is arranged to face the first expanded part B2.

While the cleaning roller 200 is in contact with the first expanded part B2, a shifting force is given to the belt due to the shifts in the degrees of parallelism of the cleaning roller 200 relative to the drive roller 52 and the follower roller 54'. However, as the first expanded part B1 is pressed, the engaged region between the engagement member 501 and the shift regulating member 561 on the support roller 500 increases so that the running quality of the belt 56 becomes more stable.

Other Examples of Illustrative Embodiment

The aforementioned descriptions represent only examples of illustrative embodiment of the present invention and the Scope of Patent claims of the present invention will not be limited thereby.

For example, as a disjunctive member, a photosensitive drum that is disjunctive to the belt 56 is applicable.

If there is a risk that the running quality of the belt 56 becomes unstable when the four photosensitive drums 42C, 42M, 42Y, and 42B in Example of Illustrative Embodiment 1 are directly in contact with the belt 56 or indirectly via the paper P, a constitution such that the cleaning roller 81 always presses the belt 56 can be introduced. However, according to the constitution in Example of Illustrative Embodiment 1, instability in running belt 56 due to the contact with the four photosensitive drums 42C, 42M, 42Y, and 42B can be suppressed to a certain degree when compared to the case when the belt 56 is not pressed at all.

The cleaning roller 81 in Example of Illustrative Embodiment 1 can be a cleaning blade. The cleaning blade may be pressed against the belt in the same manner as roller 81.

The engagement member 543 in Example of Illustrative Embodiment 1 can be formed integrally with the roller body 541.

The drive roller 52 in Example of Illustrative Embodiment 1 can contain an engagement member 543.

The printer 1 can be an inkjet type printer.

The belt in the present invention can be an intermediate transfer belt.

The belt in the present invention can be simply a belt that is used for carrying a recording medium within the image forming unit without being disposed to be faced to an image forming unit.

These and other aspects of the invention have been described with respect to the figures. Other variations will be known to those of ordinary skill in the art and are considered to be within the scope of the following claims.

What is claimed is:

1. An image forming device comprising:

an image forming unit configured to form images on an image forming medium;

a continuous belt that transports one of a recording medium and an image formed by the image forming unit, said continuous belt including a shift regulating member on an internal circumferential side of said continuous belt;

a plurality of support rollers that support the continuous belt, said plurality of support rollers including at least three rollers including:

at least one drive roller to which a driving force is supplied from a driving source, said at least one drive roller driving the continuous belt, at least one support roller among the plurality of support rollers that is different from the drive roller and has an engagement member that faces the shift regulating member, said engagement member regulating shifting of the continuous belt when engaged with the shift regulating member, and at least one another roller that is different from the at least one drive roller and different from the at least one support roller; and a pressing member that presses an outer circumferential face of the continuous belt at a first expanded part of the continuous belt suspended between the at least one support roller having the engagement member and the another support roller adjacent to the at least one support roller having the engagement member, with said pressing member pressing in a direction towards the inner circumferential side of said continuous belt;

wherein the at least one drive roller is positioned between the pressing member and a transfer position on the continuous belt where the images are transferred to the recording medium, and the at least one drive roller is positioned downstream of the transfer position and upstream of the pressing member.

2. An image forming device of claim 1, wherein the pressing member is arranged on the continuous belt such that said pressing member presses the outer circumferential face of said first expanded part that is different from a second expanded part expanded between the drive roller and the support roller, and wherein said first expanded part of said continuous belt is adjacent to said support roller having said engagement member and said second expanded part of said continuous belt performs one of supporting said medium and transferring an image formed by said image forming unit.

3. An image forming device of claim 2, wherein the image forming unit is arranged to face the second expanded part.

4. An image forming device of claim 1, wherein the pressing member is installed on the continuous belt such that said pressing member presses an outer circumferential face of the first expanded part in the upstream side to an inner circumferential side among the first expanded parts located either at a upstream side or at a downstream side in the continuous belt moving direction of the support roller having the engagement member.

5. An image forming device of claim 1, wherein said pressing member is positioned such that said pressing member presses in said first expanded part of said continuous belt such that said pressing member is closer to said support roller having the engagement member than a support roller on an opposite side of said pressing member along said continuous belt.

6. An image forming device of claim 1, wherein a position switching mechanism is installed such that the position of the pressing member is switched from the position pressing the first expanded part to a position distant from the first expanded part.

7. An image forming device of claim 6, wherein a disjunctive member is disjunctively installed on the continuous belt circumferential face and if the disjunctive member is in contact with the continuous belt circumferential face, the position switching mechanism is positioned such that the pressing member presses the first expanded part.

8. An image forming device of claim 7, wherein the disjunctive member is made of a cleaning member that removes deposits adhered on the continuous belt when the cleaning member is in contact with the continuous belt surface.

9. An image forming device of claim 8, wherein the cleaning member includes a cleaning roller.

10. An image forming device of claim 1, wherein the pressing member is a roller.

11. An image forming device of claim 1, wherein the shift regulating member is a rib and the engagement member is a flange that is arranged at the end of the support roller.

12. An image forming device of claim 1, wherein the image forming unit is equipped with a photosensitive drum having a rotary axis in parallel to the lateral direction of the continuous belt where developer images are formed, and a plurality of photosensitive drums are arranged along the continuous belt moving direction.

13. An image forming device of claim 1, wherein the image forming device includes a photosensitivity material that forms electrostatic latent images and a developing device that forms developer images by supplying a developer to the photosensitive material, where the polymer toner is used as at least part of the developer.

14. An image forming apparatus that applies an image to a medium comprising:

a continuous belt having an inner side and an outer side, said continuous belt including at least one shift regulating member applied to said inner side of said continuous belt;

at least one transport roller having a portion that engages said shift regulating member;

a drive roller spaced from the at least one transport roller;

another roller that is different from the at least one transport roller and different from the drive roller; and a pressing member engaging said continuous belt, said pressing member urged against said outer side of said continuous belt at a location between said at least one transport roller and the another roller, said location being separate from where said continuous belt contacts said rollers before said pressing member engages said continuous belt;

wherein the drive roller is positioned between the pressing member and a transfer position on the continuous belt where an image is transferred to a medium, and the drive roller is positioned downstream of the transfer position and upstream of the pressing member.

15. The image forming apparatus of claim 14, said continuous belt is an intermediate transfer belt.

16. The image forming apparatus of claim 14, said continuous belt is a conveyance belt that transports said medium.

17. The image forming apparatus of claim 14, said continuous belt is a photoreceptor belt.

18. The image forming apparatus of claim 14, said transport roller is other than a drive roller.

19. The image forming apparatus of claim 14, said pressing member intermittently engaging said continuous belt.

20. The image forming apparatus of claim 19, said pressing member intermittently engaging said continuous belt only when said image forming apparatus is not forming an image.

21. An image forming apparatus that applies an image to a medium comprising:

a continuous belt having an inner side and an outer side, said continuous belt including at least one shift regulating member applied to said inner side of said continuous belt;

at least one transport roller having a portion that engages said shift regulating member;

a drive roller spaced from the at least one transport roller; and a pressing member engaging said continuous belt, said pressing member urged against said outer side of said continuous belt;

wherein the drive roller is positioned between the pressing member and a transfer position on the continuous belt where an image is transferred to a medium, and the drive roller is positioned downstream of the transfer position and upstream of the pressing member, wherein said pressing member intermittently engages said continuous belt.

22. The image forming apparatus according to claim 21, wherein said pressing member is a blade.

23. The image forming apparatus according to claim 21, said pressing member includes a roller and said roller engages said continuous belt with friction created by said roller rotating opposite a movement direction of said continuous belt.

* * * * *